US005590791A

United States Patent [19]

Gschweitl

[11] Patent Number: 5,590,791

[45] Date of Patent: Jan. 7, 1997

[54] METHOD AND APPARATUS FOR SORTING WASTE

[75] Inventor: Karlheinz Gschweitl, Grosspesendorf, Austria

[73] Assignee: Binder & Co. Aktiengesellschaft, Gleisdorf, Austria

[21] Appl. No.: 382,243

[22] Filed: Feb. 1, 1995

[30] Foreign Application Priority Data

Feb. 1, 1994 [AT] Austria ..... 182/94
Feb. 18, 1994 [AT] Austria ..... 333/94

[51] Int. Cl.[6] ..... B07C 5/00

[52] U.S. Cl. ..... 209/577; 209/580; 209/587; 209/644; 209/930

[58] Field of Search ..... 209/577, 580, 209/587, 644, 930, 915, 919, 922; 198/370.11, 438

[56] References Cited

U.S. PATENT DOCUMENTS 3,517,807 6/1970 Gaalen ..... 209/587 X
4,946,046 8/1990 Affleck et al. .
5,443,164 8/1995 Walsh et al. ..... 209/580

*Primary Examiner*—David H. Bollinger
*Attorney, Agent, or Firm*—Collard & Roe, P.C.

[57] ABSTRACT

An apparatus for sorting pieces of waste of materials having different properties comprises a disk revolving about a substantially vertical axis and comprising a conically upwardly and outwardly tapering rim defining a conveying path, which is concave in cross section, the rim constituting an outer guide wall, and a feeding device for feeding successive pieces to the revolving conveying path at a feeding station. The revolution of the conveying path generates a centrifugal force holding the pieces against the outer guide wall, and a sensor device is arranged along the conveying path for sensing the different properties of the successive pieces. Devices controlled by the sensor device remove single pieces at discharge stations dependent on the sensed properties of the pieces.

14 Claims, 3 Drawing Sheets

FIG. 6
FIG. 6A
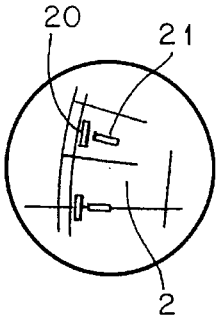
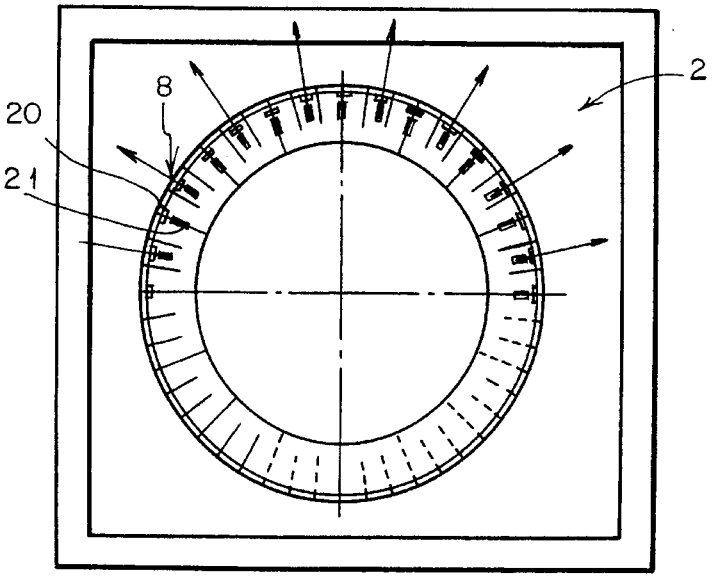
FIG. 7A
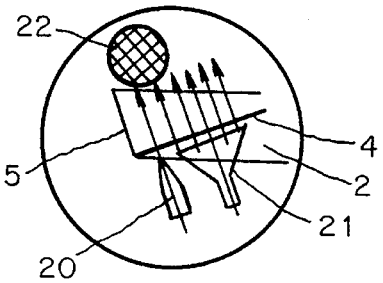
FIG. 7
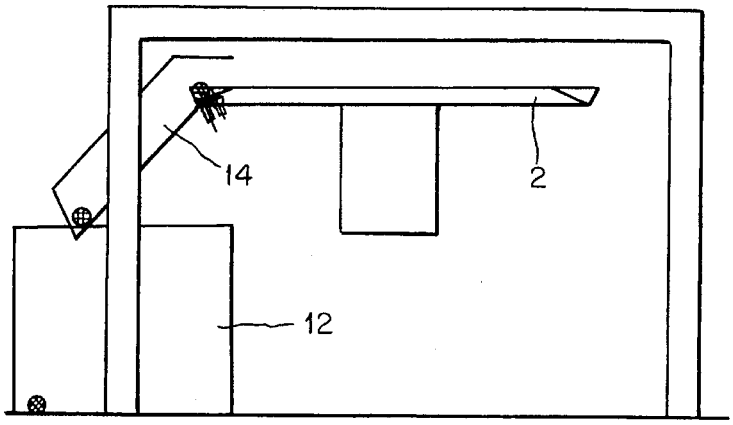
FIG. 7B
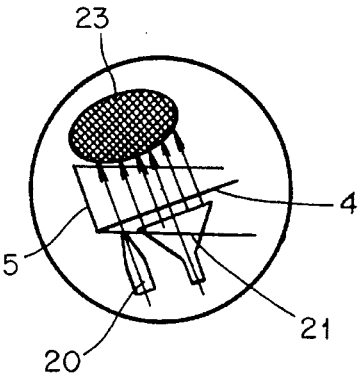

METHOD AND APPARATUS FOR SORTING WASTE

BACKGROUND OF THE INVENTION

1. Field of the Invention

The present invention relates to a method and apparatus for sorting pieces of waste of materials having different properties.

2. Description of the Prior Art

According to conventional sorting methods, the pieces are moved along a substantially straight conveying path, their different properties, including color, if desired, are sensed along the conveying path, and the pieces are then removed at respective discharge stations, dependent on the sensed properties of the materials of the pieces.

Particularly if the pieces are disposable containers, such as bottles, cans or the like, problems arise because the round pieces frequently change positions along the conveying path as they move therealong, or the pieces may jump up as they are fed to the conveying path. This may lead to an erroneous discharge of the respective pieces, thus considerably reducing the quality of the sorting. However, a precise sorting according to the different properties of the materials of the pieces is of decisive importance for the quality of any new product to be made from the sorted pieces, particularly, for example, in the recycling of synthetic resin materials.

U.S. Pat. No. 4,946,046 discloses an apparatus for sorting seeds according to color. This apparatus comprises a convex conveying path defined by the peripheral wall of a hollow drum. The peripheral wall surface has recesses for holding the seeds therein by the force of gravity, and the color of the individual seeds held in the recesses is sensed. Blow nozzles are arranged in the interior of the drum, and the recesses holding the seeds have holes through which the nozzles may blow out discolored seeds. This arrangement can be used for pieces of like size, such as seeds, which correspond to the size of the recesses. Pieces of varying sizes cannot be securely held in the recesses. Furthermore, the apparatus is extremely costly.

SUMMARY OF THE INVENTION

It is the primary object of this invention to avoid the disadvantages of the prior art and to provide a sorting method and apparatus assuring as exact a sorting according to the different properties of the materials of the pieces as possible.

According to one aspect of the invention, this and other objects are accomplished according to the invention by feeding successive ones of the pieces to a moving conveying path at a feeding station, the conveying path being concave in cross section and having an outer guide wall, and the movement of the conveying path generating a centrifugal force holding the pieces against the outer guide wall. The different properties of the successive pieces are sensed along the conveying path, and single ones of the pieces are removed at discharge stations dependent on the sensed properties of the pieces. The different properties may include a difference in infrared reflectivity, or in color.

In this sorting method, the individual pieces are kept in a stable position in the moving conveying path between the feeding and discharge stations. This assures the discharge of each piece made of a specific material at a discharge station designed for these pieces.

According to another aspect of the present invention, there is provided an apparatus for sorting pieces of waste of materials having different properties, which comprises a disk revolving about a substantially vertical axis and comprising a conically outwardly tapering rim defining a conveying path, which is concave in cross section, the rim constituting an outer guide wall. A feeding device feeds successive ones of the pieces to the revolving conveying path at a feeding station, the revolution of the conveying path generating a centrifugal force holding the pieces against the outer guide wall, and sensor means arranged along the conveying path sense the different properties of the successive pieces. Devices controlled by the sensor means remove single ones of the pieces at discharge stations dependent on the sensed properties of the pieces. The sorting cone angle of the conically outwardly tapering rim is preferably between 90° and 240°, and the sensor means may be capable of sensing the infrared reflectivity of the different materials or different colors.

Such an apparatus provides a very simple and, therefore, economically attractive structure, and the centrifugal force generated automatically by the revolving disk ensures that the individual pieces are stably held in the conveying path.

A particularly secure holding of the individual pieces in the concave conveying path will be obtained if the conveying path is defined between the conically outwardly tapering rim and a conically downwardly tapering wall which preferably encloses an angle of 2° to 45° with the horizontal.

According to another preferred feature of this invention, the downwardly tapering wall has breakthroughs, the devices for removing the pieces are blow nozzle arrangements arranged below the breakthroughs, and the apparatus further comprises collecting containers arranged opposite the blow nozzle arrangements for receiving the pieces blown out by the nozzles. This provides very simple removing devices, and the upwardly tapering outer guide wall facilitates the discharge of the blown-out pieces.

In one preferred embodiment, the devices for removing the pieces are blow nozzle arrangements comprised of a pair of blow nozzles having elongated outflow slots having a long and a short axis, the long axes of the blow nozzle slots extending substantially perpendicularly to each other. Preferably, one of the long axes extends in a circumferential direction of the disk and the other long axis extends substantially radially in the direction of the center of the disk. This arrangement has the advantage that even unfavorably shaped pieces, such as bottles of large diameter and of low weight, are dependably discharged and are blown outwardly from the disk in a substantially radial direction.

According to a preferred feature of this embodiment, the apparatus comprises two pairs of blow nozzles at each one of the discharge stations, the sensor means is capable of sensing different sizes of the pieces, and the blow nozzles of each pair are separately controllable by the sensor means. This arrangement provides a considerable saving in compressed air for the blow nozzles because smaller pieces may be discharged by actuating only one pair of nozzles while two or more pairs of blow nozzles are used for larger pieces only.

If a zone of the conveying path adjacent the outer guide wall is made of a grating, the resultant large number of breakthroughs will considerably facilitate the blowing out of the individual pieces.

The central zone of the disk inwardly of the conveying path is preferably hemispherically shaped, which has the advantage that the individual pieces will be guided to the conveying path as they are fed to the disk.

BRIEF DESCRIPTION OF THE DRAWING

The above and other objects, advantages and features of the invention will become more apparent from the following detailed description of certain now preferred embodiments thereof, taken in conjunction with the accompanying somewhat diagrammatic drawing wherein

FIG. 6 is a view similar to that of FIG. 4, illustrating another embodiment;

FIG. 6*a* is an enlarged schematic view showing a structural detail of the apparatus of FIG. 6;

FIG. 7 is schematic side view of the apparatus of FIG. 6; and

FIGS. 7*a* and 7*b* schematically show details of the operation of the apparatus illustrated in FIGS. 6 and 7.

DETAILED DESCRIPTION OF THE PREFERRED EMBODIMENTS

Figure 1:
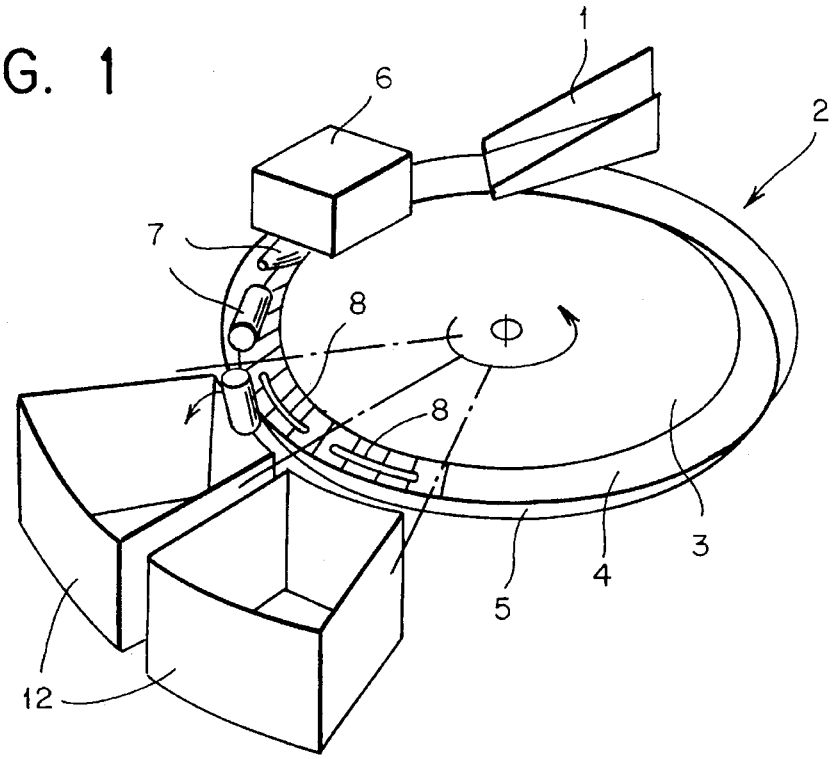
FIG. 1 is a perspective schematic view of one embodiment of the sorting apparatus of the present invention.

In the accompanying drawing, like reference numerals designate like parts functioning in a like manner in all figures.

Figure 2:
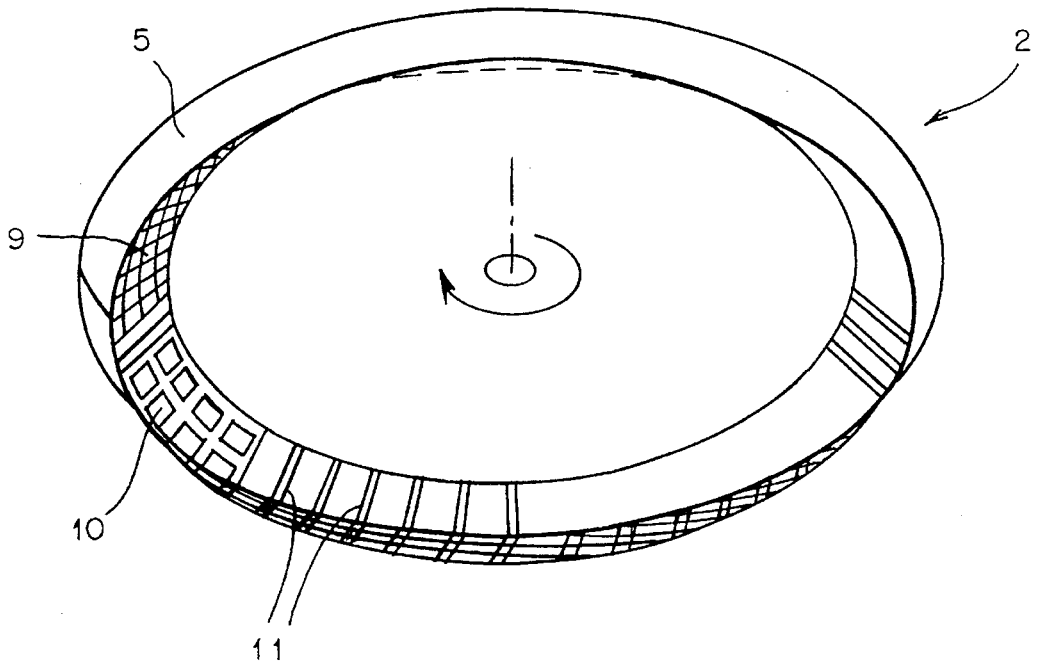
FIG. 2 is a similar top view of the disk of the apparatus of FIG. 1, showing certain structural details.

Referring first to FIGS. 1 and 2, there is illustrated an apparatus for sorting pieces 7 of waste of materials having different properties. The pieces may be bottles, cans or the like, made of materials having different properties and to be sorted according to the properties of the materials of which pieces 7 are made. The apparatus comprises disk 2 revolving about a substantially vertical axis in a direction indicated by the arcuate arrows in these figures. The central zone 3 of disk 2 is shown hemispherically shaped although it may, if desired, be flat. The disk comprises conically outwardly tapering rim 5 defining a conveying path extending adjacent rim 5 and surrounding central zone 3, and this conveying path is concave in cross section. The rim constitutes an outer guide wall, and a feeding device constituted by chute 1 feeds successive pieces 7 to the revolving conveying path at a feeding station. The revolution of the conveying path generates a centrifugal force holding pieces 7 against outer guide wall 5. The cone angle of conically outwardly tapering rim 5 is between 90° and 240°.

In the illustrated embodiment, the concave conveying path is defined between outer guide wall 5 and a conically downwardly tapering wall 4 surrounding the central disk zone and surrounded by the outer guide wall, the walls defining a groove therebetween which constitutes the conveying path. The conically downwardly tapering wall 4 encloses an angle of 2° to 45° with the horizontal.

Feed chute 1 slopes down at a relatively small angle of inclination and is aligned tangentially with the groove constituting the conveying path so that successive pieces 7 slide readily into the groove. As the pieces slide into the revolving groove, the centrifugal force generated by the revolution of disk 2 will hold the pieces stably against outer guide wall 5 which tapers conically upwardly and outwardly. Therefore, they will not change their position in the conveying path.

As best shown in FIG. 2, downwardly tapering wall 4 has a large number of breakthroughs, being formed, for example, of a wire grating 9, a rib mesh 10 or by spaced rods 11 arranged at a small distance from each other. This provides a large air-permeable area.

Sensor device 6 arranged along the conveying path downstream of feed chute 1 in the direction of rotation of disk 2 senses the different properties of the successive pieces. The sensor device has sensors capable of sensing the infrared reflectivity of the different materials and thereby to detect the material of which pieces 7 are made. It may also have sensors capable of sensing different colors when a sorting according to colors is desired, particularly in the case of sorting synthetic resin materials. The color sensors may operate according to the method of incident light for sensing the color of opaque pieces 7 or with transmitted light for transparent pieces.

The apparatus further comprises devices 8 controlled by the sensors of sensor device 6 for removing single pieces 7 at discharge stations dependent on the sensed properties of the pieces. The removing devices 8 are blow nozzle arrangements arranged below the breakthroughs, and the blow nozzles are outwardly directed to blow pieces 7 into collecting containers 12 arranged opposite the blow nozzle arrangements for receiving the pieces blown out by the nozzles.

Depending on the material of each piece 7 detected by sensor device 6 and, optionally, its color, a respective removing device 8 is actuated by the sensor device when the piece has reached this removing device, which depends on the speed of rotation of disk 2. A relatively large number of removing devices 8 may be distributed over the circumference of the disk, and this will make it possible to sort pieces 7 of a number of different properties, including different sizes to be sensed. Collecting containers 12 are arranged adjacent the circumference of disk 2 opposite respective discharge devices 8 so that pieces of materials of the same property will dependably be discharged into respective containers.

Figure 3:
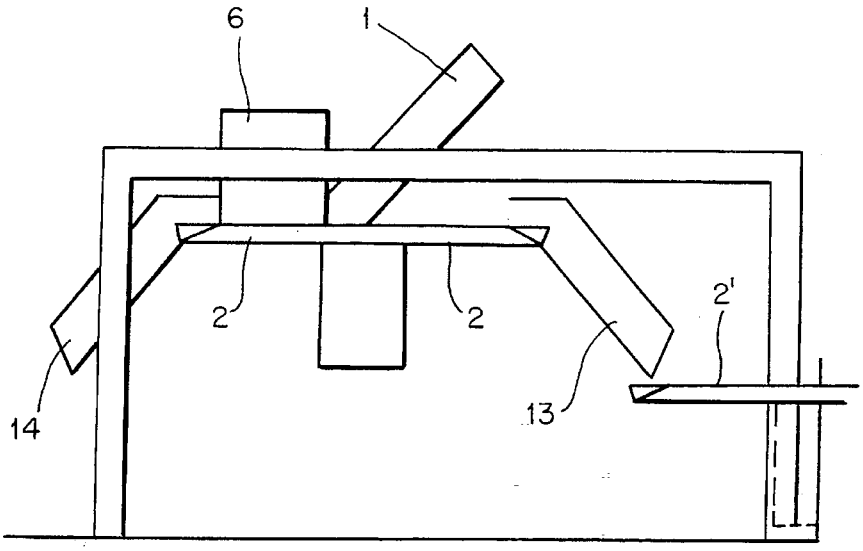
FIG. 3 is a schematic side view of another embodiment.
Figure 4:
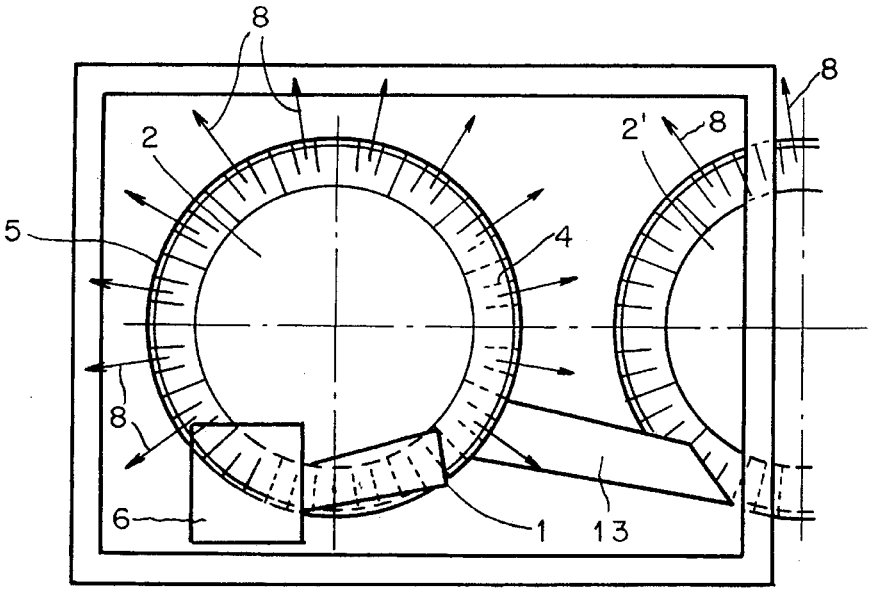
FIG. 4 is a top view of the apparatus shown in FIG. 3.

In the embodiment of FIGS. 3 and 4, the arrangement of disk 2 is similar to that of the disk described hereinabove but, instead of providing collecting containers at the discharge stations, chutes 14 are arranged opposite respective discharge devices. Furthermore, a second disk 2' is arranged adjacent disk 2 and a transfer chute 13 is arranged opposite another removing device for transferring all pieces 7 which have not been blown out by the sensor-controlled removing devices 8 to disk 2'. Disk 2' is similar to disk 2 and sorts the pieces transferred thereto of a number of further different properties for corresponding containers.(not shown).

As shown by arrows 8 in FIG. 4, the blow nozzles are substantially radially aligned, and a preferred arrangement will be described hereinafter in connection with FIG. 6*a*.

Figures 5A, 5B, 5C, 5D:
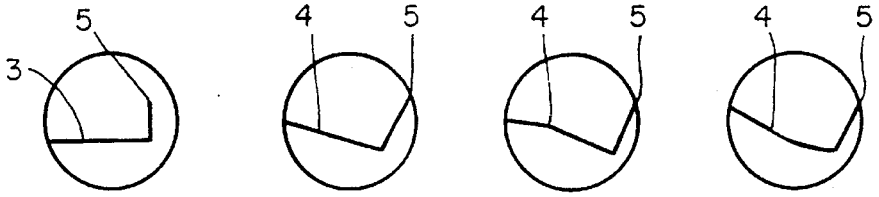
FIGS. 5*a* to 5*d* schematically show various embodiments of the border region of the disk.

Various arrangements of outer guide wall 5 are schematically shown in FIGS. 5*a* to 5*d*. According to FIG. 5*a*, the outer guide wall may project upwardly directly from central zone 3 of the disk, which may be flat. In FIG. 5*b*, a zone 4 adjacent outer guide wall 5 may slope downwardly towards outer guide wall 5, i.e. the central zone of the disk may be conically shaped. FIG. 5*c* shows a hemispherically shaped central disk zone to define a downwardly sloping zone 4 adjacent the outer guide wall. The angle of inclination of sloping zone 4 in FIG. 5*d* is somewhat smaller than that of FIG. 5*c*. Sloping zone 4 forms substantially a truncated cone.

The embodiment of FIGS. 6 and 7 differs from the previously described embodiments by the specific arrangement of blow nozzles 8. In this embodiment, devices 8 for removing the pieces are blow nozzle arrangements comprised of a pair of blow nozzles 20, 21 (see FIG. 6*a*) having elongated outflow slots having a long and a short axis, the long axes of the blow nozzles extending substantially perpendicularly to each other. The long slot axis of blow nozzle 20 extends in a circumferential direction of disk 2, and the long slot axis of blow nozzle 21 extends substantially radially in the direction of the center of the disk. This provides a substantially T-shaped nozzle arrangement. At least two pairs of blow nozzles may be arranged at each one of the discharge stations, the sensor device may be capable of sensing different sizes of the pieces, and the blow nozzles of each pair are separately controllable by the sensor device.

As is shown in FIGS. 7*a* and 7*b*, the T-shaped nozzle arrangement leads to a dependable discharge of differently shaped pieces, i.e. pieces 22 of a round cross section and pieces 23 of an oval cross section. The blow nozzles 21, which are inclined towards the horizontal in a direction away from the disk, will direct their full blast over the entire surface of oval piece 23 to blow them radially outwardly over outer guide wall 5, while blow nozzles 20 may suffice for removing round pieces 22.

What is claimed is:

1. A method of sorting pieces of waste of material having different properties, which comprises the steps of (a) feeding successive ones of the pieces to a conveying path revolving about a substantially vertical axis at a feeding station, (1) the conveying path being concave in cross section and having an outer guide wall, and (2) the revolution of the conveying path generating a centrifugal force holding the pieces against the outer guide wall, (b) sensing the different properties of the successive pieces along the conveying path, and (c) directing an upward and outward air stream from below the conveying path against single ones of the pieces at discharge stations dependent on the sensed properties of the pieces to remove said single pieces from the conveying path.

2. The method of claim 1, wherein the different properties include a difference in infrared reflectivity.

3. The method of claim 1, wherein the different properties include a difference in color.

4. An apparatus for sorting pieces of waste of materials having different properties, which comprises (a) a disk comprising (1) a rim extending upwardly and outwardly at an angle from the circumference of the disk and a wall extending upwardly and inwardly at an angle from the rim, the rim and the wall defining a conveying path therebetween, which is concave in cross section, and the rim constituting an outer guide wall, (b) means for revolving the disk about a substantially vertical axis, (c) a feeding device for feeding successive ones of the pieces to the revolving conveying path at a feeding station, (1) the revolution of the conveying path generating a centrifugal force holding the pieces against the outer guide wall, (d) sensor means arranged along the conveying path for sensing the different properties of the successive pieces, and (e) blow nozzle arrangements arranged below breakthroughs in the upwardly and inwardly extending wall controlled by the sensor means for removing single ones of the pieces at discharge stations dependent on the sensed properties of the pieces, the blow nozzle arrangements comprising blow nozzles having upwardly and outwardly directed axes.

5. The sorting apparatus of claim 4, wherein the sensor means is capable of sensing the infrared reflectivity of the different materials.

6. The sorting apparatus of claim 4, wherein the sensor means is capable of sensing different colors.

7. The sorting apparatus of claim 4, wherein the wall encloses an angle of 2° to 45° with the horizontal.

8. The sorting apparatus of claim 4, further comprising collecting containers arranged opposite the blow nozzle arrangements for receiving the pieces blown out by the nozzles.

9. The sorting apparatus of claim 4, wherein the blow nozzle arrangements are comprised of a pair of blow nozzles having elongated outflow slots having a long and a short axis, the long axes of the blow nozzle slots extending substantially perpendicularly to each other.

10. The sorting apparatus of claim 9, wherein one of the long axes extends in a circumferential direction of the disk and the other long axis extends substantially radially in the direction of the center of the disk.

11. The sorting apparatus of claim 9, comprising two pairs of blow nozzles at each one of the discharge stations, the sensor means is capable of sensing different sizes of the pieces, and the blow nozzles of each pair are separately controllable by the sensor means.

12. The sorting apparatus of claim 4, wherein the conveying path adjacent the outer guide wall is made of a grating defines the breakthroughs.

13. The sorting apparatus of claim 4, wherein a central zone of the disk inwardly of the conveying path is hemispherically dome-shaped.

14. The sorting apparatus of claim 4, wherein the rim encloses an angle of 90° to 240° with the disk.

* * * * *